US009508289B2

(12) United States Patent
Bae

(10) Patent No.: US 9,508,289 B2
(45) Date of Patent: Nov. 29, 2016

(54) DISPLAY DEVICE AND DISPLAY DRIVING METHOD THEREOF

(71) Applicant: SAMSUNG DISPLAY CO., LTD., Yongin, Gyeonggi-Do (KR)

(72) Inventor: Young Min Bae, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 160 days.

(21) Appl. No.: 14/283,134

(22) Filed: May 20, 2014

(65) Prior Publication Data

US 2015/0170577 A1 Jun. 18, 2015

(30) Foreign Application Priority Data

Dec. 18, 2013 (KR) ..... 10-2013-0158708

(51) Int. Cl.
*G09G 3/32* (2016.01)

(52) U.S. Cl.
CPC ..... *G09G 3/3291* (2013.01); *G09G 3/3233* (2013.01); *G09G 2320/0276* (2013.01); *G09G 2320/0673* (2013.01); *G09G 2330/028* (2013.01); *G09G 2340/0428* (2013.01)

(58) Field of Classification Search
CPC ..... G09G 2320/0276; G09G 2320/0673; G09G 2330/028; G09G 2340/0428; G09G 3/3233; G09G 3/3291
See application file for complete search history.

(56) References Cited

U.S. PATENT DOCUMENTS 5,754,150 A * 5/1998 Matsui ..... G09G 3/3648 345/207
2011/0115832 A1* 5/2011 Lee ..... G09G 3/3233 345/690
2013/0189808 A1 7/2013 Hack et al.

FOREIGN PATENT DOCUMENTS

KR 10-2008-0024437 A 3/2008
KR 10-2009-0067457 A 6/2009
KR 10-2010-0073654 A 7/2010
KR 10-2012-0042004 A 5/2012

* cited by examiner

*Primary Examiner* — Latanya Bibbins
(74) *Attorney, Agent, or Firm* — Lewis Roca Rothgerber Christie LLP

(57) ABSTRACT

A display device includes pixel circuits with light emitting devices coupled to a first voltage and a second voltage; a signal controller configured to: generate output image data by gamma converting and by decreasing input image data of a frame according to a gamma curve; and generate a control signal to display an image on the panel according to the generated output image data; a voltage difference setting unit configured to detect a maximum value in the output image data, and configured to calculate a difference value between the first voltage and the second voltage so that a driving current corresponding to the maximum value is generated; and a power supply unit configured to generate and apply the first and second voltages to the panel, the generated first and second voltages corresponding to the calculated difference value, wherein the gamma curve comprises one or more inflection points.

19 Claims, 10 Drawing Sheets

DISPLAY DEVICE AND DISPLAY DRIVING METHOD THEREOF

CROSS-REFERENCE TO RELATED APPLICATION

This application claims priority to and the benefit of Korean Patent Application No. 10-2013-0158708 filed in the Korean Intellectual Property Office on Dec. 18, 2013, the entire contents of which are incorporated herein by reference.

BACKGROUND

1. Field

Embodiments of the present invention relate to a display device, and a driving method thereof.

2. Description of the Related Art

A display device includes a display panel including a plurality of pixel circuits arranged in a matrix form. The display panel includes a plurality of scan lines in rows, and a plurality of data lines formed in a column direction, and the plurality of scan lines and the plurality of data lines are arranged such that they cross each other. Each of the plurality of pixels is driven by a scan signal and a data signal transmitted from a corresponding scan line and a corresponding data line, respectively, and a driving voltage.

The type of the display device is divided into a passive matrix type light emitting display device, and an active matrix type light emitting device, according to a driving method of a pixel. Among the two types, the active matrix type light emitting display device, in which every unit pixel is selectively turned on, is mainly used due to its resolution, contrast, and the speed at which it operates.

Flat panel display devices, such as organic light emitting diode displays, are being developed. The organic light emitting diode display displays an image by using an organic light emitting diode OLED that generates light through recombination of electrons and holes, and that has attracted attention because of its merits with respect to rapid response speed, driving at low power consumption, and excellent luminous efficiency, luminance, and viewing angle.

Generally, pixels emitting light in an organic light emitting diode display each include an organic light emitting diode, and the organic light emitting diode generates light corresponding to a data current supplied from a pixel circuit.

A gamma (γ) curve and luminance of the light emitting diode display are implemented by a gamma voltage through a decoder via an amplifier (AMP) of a source channel of a driver IC. In order to secure outdoor visibility of a low grayscale level, visibility may be secured through gamma voltage control by the AMP.

However, because values that are changed for each of the modules are different, it is not easy to apply the gamma voltage control by the AMP in the related art to actual production.

Further, when an AM OLED impulse driving (AID) is implemented with a low grayscale level, the gamma curve deviates from the target. Because the gamma curve deviates from the target, tack time is also increased due to a characteristic of the module for which the value needs to be changed.

The above information disclosed in this Background section is only for enhancement of understanding of the background of the invention and therefore it may contain information that are already known by a person of ordinary skill in the art.

SUMMARY

Embodiments of the present invention are described to provide a display device and a driving method thereof, which allow for improved outdoor visibility at a low grayscale level.

Further, embodiments of the present invention have been described to provide a display device and a driving method thereof, which decrease power consumption by minimizing a size of a driver IC and by allowing a gamma curve change and an auto current limit (ACL) at low grayscale levels.

Further, embodiments of the present invention have been described to provide a display device and a driving method thereof, which improve an image quality through a level adjustment.

Technical aspects in the present invention are not limited to the mentioned technical aspects. Those skilled in the art may clearly understand other non-mentioned technical aspects from the description of the present invention.

An example embodiment of the present invention may provide a display device including a panel having a plurality of pixel circuits, each of the pixel circuits having a light emitting device including a first terminal coupled to a first voltage, and a second terminal coupled to a second voltage; a signal controller configured to: generate output image data by gamma converting and by decreasing input image data of a frame according to a gamma curve; and generate a control signal to display an image on the panel according to the generated output image data; a voltage difference setting unit configured to detect a maximum value in the output image data, and configured to calculate a difference value between the first voltage and the second voltage so that a driving current corresponding to the maximum value is generated; and a power supply unit configured to generate and apply the first and second voltages to the panel, the generated first and second voltages corresponding to the calculated difference value, wherein the gamma curve comprises one or more inflection points.

The one or more inflection points may include a first inflection point and a second inflection point.

The gamma curve may represent a relationship between the input image data corresponding to grayscale data and the output image data.

The signal controller may include a gamma conversion unit configured to perform gamma conversion, wherein the gamma conversion unit is configured to generate a converted gamma curve such that the gamma curve prior to the gamma conversion passes through the first and second inflection points.

The converted gamma curve may include a first section, a second section, and a third section, wherein the first section includes a first inclination formed between a starting point of the converted gamma curve and the first inflection point, wherein the second section includes a second inclination formed between the first inflection point and the second inflection point, and wherein the third section includes a third inclination formed between the second inflection point and a maximum value of the input image data.

The first inclination may be larger than the second inclination; and the third inclination may be larger than the second inclination.

A grayscale section corresponding to the first section may be lower than a grayscale section corresponding to the second section.

The gamma conversion unit may be configured to gamma convert the input image data corresponding to the first grayscale section among all grayscale levels according to the first inclination, and may also be configured to: perform the gamma conversion for the first section according to the first inclination; perform the gamma conversion for the second section according to the second inclination; and perform the gamma conversion for the third section according to the third inclination.

The gamma conversion unit may be configured to generate the gamma converted image data including red, green, and blue gamma data by using the gamma converted gamma data.

Another example embodiment of the present invention may provide a method of driving a display device including a panel having a plurality of pixel circuits, each of which includes a light emitting device having a first terminal coupled to a first voltage, and a second terminal coupled to a second voltage, the method including: gamma converting input image data of a frame unit according to a gamma curve; decreasing the input image data; generating output image data by using the decreased image data and gamma converted image data; and generating a control signal to display an image according to the generated output image data.

The decreasing the input image data may include: detecting a maximum value among the input image data; calculating a difference value between the first voltage and the second voltage; generating a driving current corresponding to the maximum value; and generating the first voltage and the second voltage according to the calculated difference value.

The gamma converting may include setting one or more inflection points.

The gamma curve may represent a relationship between the input image data, which corresponds to grayscale data, and the output image data.

The gamma converting may further include generating a converted gamma curve such that the gamma curve prior to gamma conversion passes through the first inflection point and the second inflection point.

The converted gamma curve may include a first section, a second section, and a third section; the first section includes a first inclination between a starting point of the converted gamma curve and the first inflection point; the second section includes a second inclination between the first inflection point and the second inflection point; and the third section includes a third inclination between the second inflection point and a maximum value of the input image data.

The first inclination may be larger than the second inclination; and the third inclination may be larger than the second inclination.

The gamma converting may further include: performing the gamma conversion for the first section according to the first inclination; performing the gamma conversion for the second section according to the second inclination; and performing the gamma conversion for the third section according to the third inclination.

A grayscale section corresponding to the first section may be lower than a grayscale section corresponding to the second section.

The gamma converting may further include generating the gamma converted image data including red, green, and blue gamma data by using the gamma converted gamma data.

DETAILED DESCRIPTION OF THE EMBODIMENTS

Figure 1:
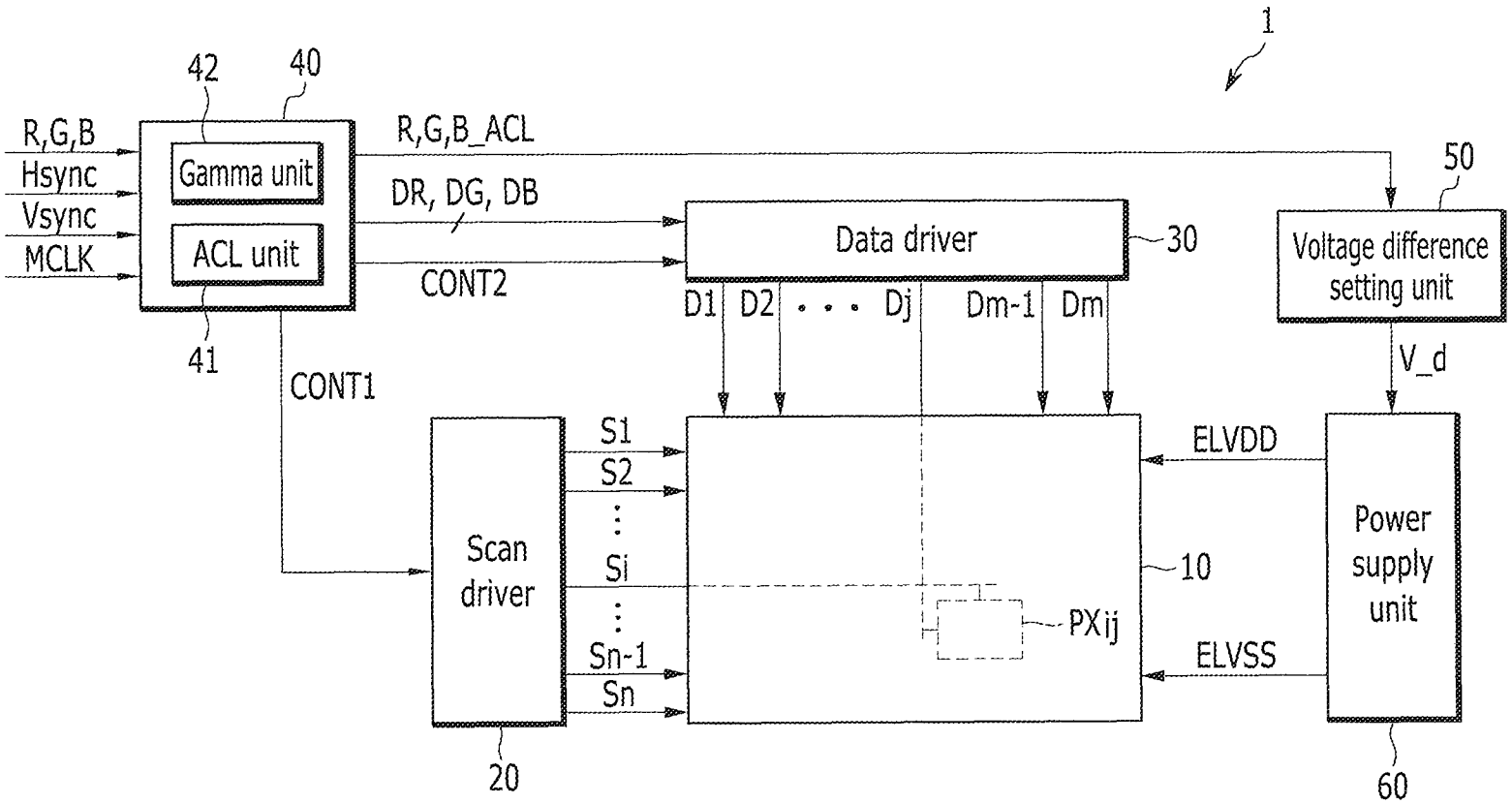
FIG. 1 is illustrates a display device according to an example embodiment of the present invention.

The embodiments of the present invention will be described more fully hereinafter with reference to the accompanying drawings, in which example embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

In addition, unless explicitly described to the contrary, the word "comprise" and variations such as "comprises" or "comprising", or the word "include" and variations such as "includes" or "including", will be understood to imply the inclusion of stated elements but not the exclusion of any other elements. In addition, terms, including the suffixes "-er" and "-or", and the term "module," as described in the specification mean units for processing at least one function or operation, and can be implemented by hardware components or software components and combinations thereof.

FIG. 1 illustrates a display device according to an example embodiment of the present invention.

Referring to FIG. 1, a display device according to an example embodiment of the present invention will be described.

A display device 1 includes a panel 10, a scan driver 20, a data driver 30, a signal controller 40, a voltage difference setting unit 50, and a power supply unit 60.

In some embodiments, the panel 10 includes a plurality of signal lines S1 to Sn and D1 to Dm, and a plurality of pixels PX coupled to the plurality of signal lines S1 to Sn and D1 to Dm in a substantially matrix form. The display signal lines S1 to Sn and D1 to Dm include a plurality of scan signal lines S1 to Sn for transmitting scan signals, and a plurality of data lines D1 to Dm for transmitting data signals. The scan lines S1 to Sn approximately extend in a row direction, and are in parallel with each other, and the data lines D1 to Dm approximately extend in a column direction, and are also in parallel with each other. FIG. 1 illustrates an example pixel PXij formed in a region of the panel 10 where an $i^{th}$ arranged scan line Si and a $j^{th}$ arranged data line Dj cross each other.

In some embodiments, the pixel circuit PX includes a light emitting device (for example, an organic light emitting diode (OLED)). The light emitting device is coupled with the power supply unit 60, which is configured to supply a first voltage ELVDD and a second voltage ELVSS. In particular, a first end and a second end of the organic light emitting diode OLED are electrically coupled with the first voltage ELVDD and the second voltage ELVSS, respectively, and the OLED emits light according to a current flowing between both of the terminals. Here, the current flowing between the terminals of the light emitting device is referred to as a driving current $I_{_oled}$.

Each of the pixel circuits generates the driving current $I_{_oled}$ according to a voltage data signal, the first voltage EVLDD, and the second voltage ELVSS, and supplies the respective generated driving current $I_{_oled}$ to the organic light emitting diode, which emits light with a luminance proportional to the driving current $I_{_oled}$.

The signal controller 40 receives a plurality of image data R, G, and B, a horizontal synchronization signal Hsync, a vertical synchronization signal Vsync, and a clock signal MCLK, and generates a scan control signal CONT1 and a data control signal CONT2 for displaying an image on the panel 10 according to the received image data R, G, and B, and also generates a plurality of data signals DR, DG, and DB corresponding to the plurality of image data R, G, and B. Here, the image data R, G, and B includes a plurality of grayscale data controlling luminance of each of the plurality of pixels.

The signal controller 40 may include an ACL unit 41 and a gamma unit 42.

The ACL unit 41 receives image data R, G, B_Di of one frame unit (i.e., a single frame) and collectively decreases the data. Here, the decrease in the data refers to a decrease in a size of output image data R, G, B_Do so that a current flowing in the organic light emitting diode OLED is limited. Here, the image data decreased by the ACL unit 41 is referred to as decreased image data R, G, B_ACL.

The gamma unit 42 performs gamma conversion so that a gamma curve of the input image data R, G, B_Di passes through an inflection point. Here, the gamma curve is a graph illustrating a relationship between input image data corresponding to grayscale data, and the output image data R, G, B_Do representing a data voltage to be supplied to the display device considering the grayscale data and a luminance characteristic of the display device. The gamma conversion refers to conversion of gamma data of the input image data R, G, B_Di. Here, the data, which is gamma-converted by the gamma unit 42, is referred to as gamma image data R, G, B_Gamma. The gamma unit 42 generates the gamma image data R, G, B_Gamma of one frame unit.

The signal controller 40 generates the output image data R, G, B_Do including the grayscale data by using the decreased image data R, G, B_ACL and the gamma image data R, G, B_Gamma.

The voltage difference setting unit 50 detects a maximum value in the decreased image data R, G, B_ACL, and calculates a difference value V_d between the first voltage ELVDD and the second voltage ELVSS to generate a driving current $I_{_oled}$ corresponding to the detected maximum value. Here, the maximum value refers to a size of the decreased image data R, G, B_ACL illustrating maximum luminance in the decreased image data R, G, B_ACL of one frame unit.

The power supply unit 60 generates a first voltage ELVDD and a second voltage ELVSS corresponding to the difference value V_d between the first voltage ELVDD and the second voltage ELVSS, which is calculated by the voltage difference setting unit 50.

For example, when a difference value between the first voltage ELVDD and the second voltage ELVSS is referred to as Vdelta, the second voltage ELVSS may be a set value, and the first voltage ELVDD may be a set value obtained by adding Vdelta to the second voltage ELVSS. Further, the first voltage ELVDD may be a set value, and the second voltage ELVSS may be a set value obtained by subtracting Vdelta from the first voltage ELVDD. Thus, when setting the first voltage ELVDD and the second voltage ELVSS, a data voltage range is considered.

The scan driver 20 generates a plurality of scan signals S1 to Sn according to a scan control signal CONT1. The scan signals S1 to Sn are for transmitting a plurality of voltage data signals D1 to Dm, and are sent to a respective one of the plurality of scan lines. That is, the scan signal, in an active state, is transmitted to one of the plurality of scan lines, and the plurality of data signals is transmitted to the corresponding plurality of pixel circuits coupled to the corresponding scan line, such that the plurality of data signals is written in the corresponding plurality of pixel circuits coupled to the respective scan line.

The data driver 30 receives a plurality of data signals DR, DG, and DB generated in the signal controller 40, and generates the plurality of data signals D1 to Dm according to the plurality of data signals D1 to Dm corresponding to one scan line. The data driver 30 transmits the plurality of data signals D1 to Dm to the respective data lines, the data signals D1 to Dm being generated according to the data control signal CONT2.

The scan control signal CONT1 and the data control signal CONT2 are synchronized with each other. Accordingly, when the scan driver 20 applies the scan signal in the active state to one scan line among the plurality of scan lines S1 to Sn according to the scan control signal CONT1, the data driver 30 transmits the data signals corresponding to the scan line to which the scan signal in the active state is applied to the data lines D1 to Dm.

Figure 2:
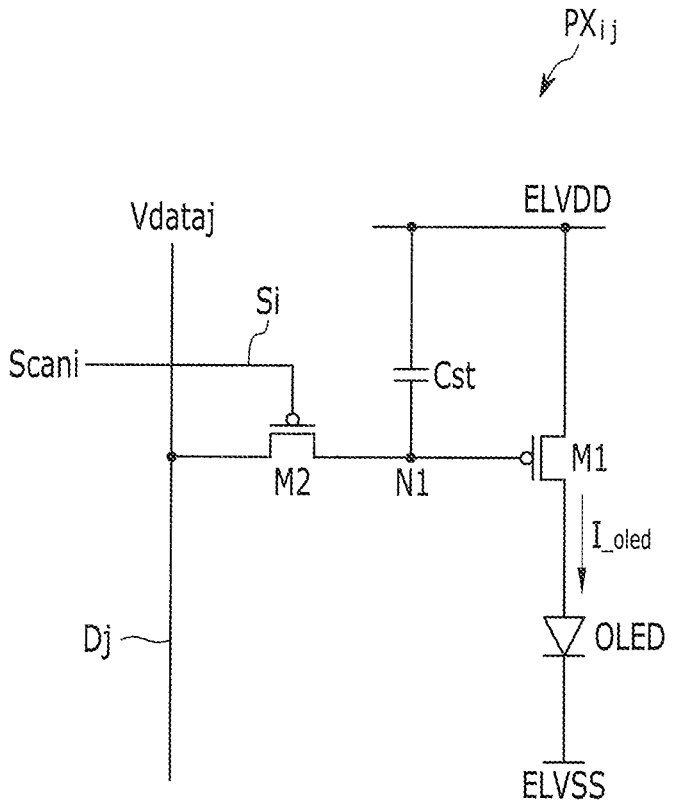
FIG. 2 is illustrates a pixel circuit according to an example embodiment of the present invention.

FIG. 2 illustrates a pixel circuit PXij of a pixel coupled to an $i^{th}$ scan line Si and a $j^{th}$ data line Dj among the pixels of FIG. 1. Here, i and j are $1 \le i \le n$, and $1 \le j \le m$.

Hereinafter, the pixel circuit of the plurality of pixels in the display device of FIG. 1 will be described with reference to FIG. 2.

The pixel circuit PXij may be coupled with the $i^{th}$ scan line Si and the $j^{th}$ data line Dj, and includes the organic light emitting diode OLED coupled between the first voltage ELVDD and the second voltage EVLSS, but is not limited thereto.

The pixel circuit PXij further includes a driving transistor M1, a capacitor Cst, and a switching transistor M2. Here, the driving transistor M1 the switching transistor M2 may be formed of a P-type MOS transistor.

The driving transistor M1 includes a source terminal coupled with the first voltage ELVDD, a gate terminal coupled with a first node N1, and a drain terminal coupled with an anode terminal of the organic light emitting diode OLED. The switching transistor M2 includes a source terminal receiving a voltage data signal Vdataj, a gate terminal receiving a scan signal Scani, and a drain terminal coupled with the gate terminal of the driving transistor M1.

The capacitor Cst is coupled between the first voltage EVLDD and the first node N1, and stores a voltage corresponding to a difference between the voltage data signal Vdataj and the first voltage ELVDD.

An operation of the pixel circuit PXij according to an embodiment of the present invention will be described. First, the scan signal Scani (which is an enable signal) is transmitted to the gate terminal of the switching transistor M2. Then, the switching transistor is turned on. The data signal Vdataj is transmitted to the first node N1 through the turned-on switching transistor M2. Subsequently, the capacitor Cst is charged with a voltage corresponding to the difference between the voltage data signal Vdataj and the first voltage ELVDD.

Then, the driving transistor M1 causes the driving current $I_{_oled}$, which varies according to a size of the voltage stored in the capacitor Cst, flow to the organic light emitting diode OLED. Then, the organic light emitting diode OLED emits light that is proportional to the size of the driving current $I_{_oled}$. That is, as the amount of the driving current $I_{_oled}$ is increased, the amount of light emitted by the organic light emitting diode (OLED) is increased.

The first voltage ELVDD and the second voltage ELVSS are determined according to the desired maximum luminance. Maximum luminance refers to the maximum luminance among the luminance displayed by the panel 10. The maximum luminance may be changed in each unit of a frame. As the image becomes brighter, the maximum luminance becomes higher.

The driving transistor M1 according to the example embodiment of the present invention is controlled so as to be operated in a saturation region to supply a current to the organic light emitting diode according to the data signal. When the same data signal is transmitted to the gate electrode, and when a voltage between the drain electrode and the source electrode is equal to or larger than a predetermined threshold value, the driving transistor M1 is operated in the saturation region.

A voltage of the source terminal of the driving transistor M1 is the first voltage ELVDD, and a voltage of the drain terminal is determined according to the second voltage ELVSS. When a voltage range of the data signal is set, a difference between the first voltage ELVDD and the second voltage ELVSS is set to be larger than a threshold voltage to operate the driving transistor M1 in the saturation region. As the maximum luminance becomes higher, an amount of the current $I_{_OLED}$ flowing in the organic light emitting diode OLED is larger. Thus, a difference between the voltage of the source terminal and the voltage of the gate terminal of the driving transistor M1 is larger.

Accordingly, as the maximum luminance becomes higher, the first voltage ELVDD is set as a larger voltage, and the second voltage ELVSS is set such that a voltage difference between the second voltage ELVSS and the threshold voltage is larger than a voltage different between the first voltage ELVDD and the threshold voltage.

Particularly, in some embodiments, when the driving transistor M1 generates the driving current according to the data signal, the voltage difference between the first voltage ELVDD and the second voltage ELVSS is distributed according to a ratio between a resistance of the driving transistor M1 in an ON state and a resistance of the organic light emitting diode (OLED). That is, when the voltage difference between the first voltage ELVDD and the second voltage ELVSS is equal to or larger than a desired voltage, the drain and source voltages of the driving transistor M1 and the voltages of both terminals of the organic light emitting diode OLED are equal to or larger than the desired voltage.

In some embodiments, power consumption is determined by the current flowing in the driving transistor M1 and the voltage difference between the drain electrode and the source electrode. Therefore, for a given current flow through the driving transistor M1, as the voltage difference between the drain and source terminals become large, the power consumption is increased. Even in a case where a relatively low driving current flows through the driving transistor M1, when the first voltage ELVDD and the second voltage ELVSS are fixed, the voltages of the drain and source terminals have a value equal to or larger than the suitable voltage. Accordingly, unnecessary power consumption is generated in the driving transistor M1.

Furthermore, even when a relatively low driving current flows through the driving transistor M1, the voltage of both terminals of the organic light emitting diode OLED is also a voltage equal to or larger than the suitable voltage. Therefore, unnecessary power consumption is generated in the organic light emitting diode.

Accordingly, when the second voltage ELVSS and the first voltage ELVDD are set in accordance with the maximum luminance, unnecessary power consumption is generated in the driving transistor M1 and the organic light emitting diode OLED when the organic light emitting diode OLED emits light with a luminance less than the maximum luminance.

In the example embodiment of the present invention, to prevent the unnecessary power consumption, the voltage difference setting unit 50 generates the difference value V_d between the first voltage ELVDD and the second voltage ELVSS by using the decreased image data R, G, B_ACL generated to correspond to the maximum luminance for each frame, so that unnecessary power consumption is reduced or prevented.

Figure 3:
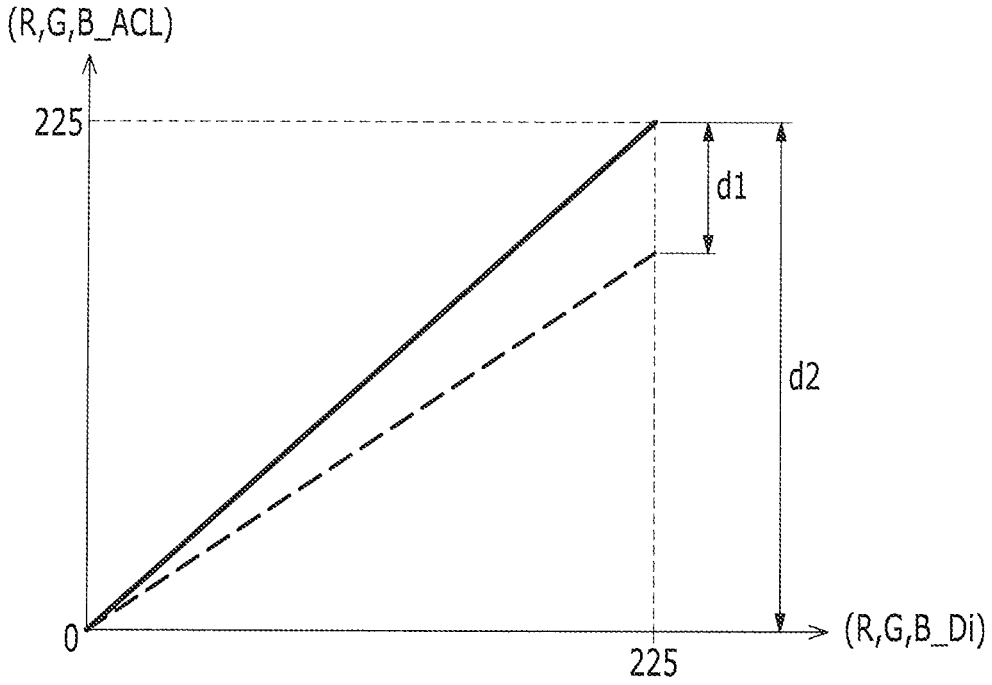
FIG. 3 is a graph for describing a decrease in data of an ACL unit according to an embodiment of the present invention.

FIG. 3 is a graph for describing a decrease in the ACL unit 41.

Hereinafter, the ACL unit 41 according to the example embodiment of the present invention will be described with reference to FIG. 3.

Referring to FIG. 3, the x-axis indicates a value of the input image data R, G, B_Di and the y-axis indicates a value of the decreased image data R, G, B_ACL. According to the present embodiment, the ACL unit 41 decreases each of the image data R, G, and B in a single frame by a first ratio (d1/d2).

Here, the first ratio (d1/d2) is set as a value proportional to sizes of entire image data R, G, and B displayed on the panel 10. Further, in a case of a high quality display device, a first decrease quantity d1 may be set as a relatively small value.

Here, the first decrease quantity d1 is set as a value proportional to the sizes (grayscales represented by the image data) of the entire image data R, G, and B displayed on the display panel 10. However, in a case of the display device which implements a high quality image by exhibiting high luminance, the first decrease quantity d1 may be set as a smaller value than that of a general display device. That is, the first decrease quantity d1 is a value set as a different value according to the input image data and a product specification of the display device 1. For example, in the same display device 1, when luminance of the image displayed by the image data is high, the decrease quantity d1 is set as a relatively large value, and when the luminance of the image displayed by the image data is low, the decrease quantity d1 is set as a relatively small value.

Figure 4:
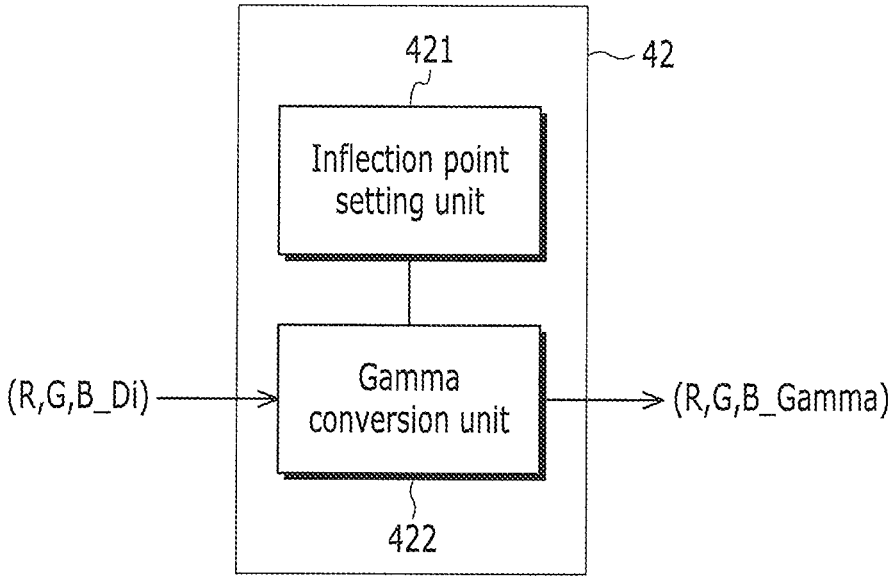
FIG. 4 illustrates a gamma unit according to an embodiment of the present invention.

FIG. 4 illustrates the gamma unit, according to an embodiment of the present invention.

Figure 5:
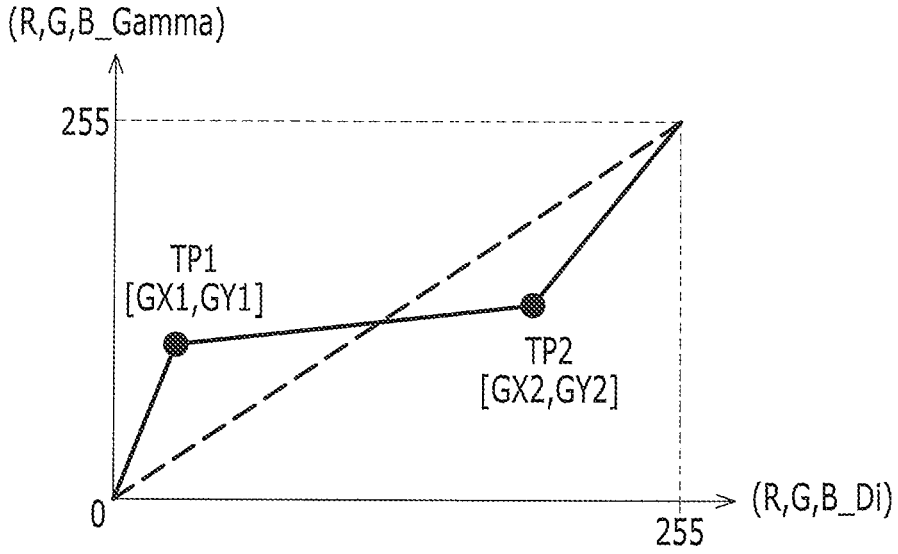
FIG. 5 is a graph illustrating a relationship between input image data and gamma image data according to an embodiment of the present invention.

FIG. 5 is a graph illustrating a relationship between the input image data and the gamma image data.

Hereinafter, a gamma conversion operation of the gamma unit according to the example embodiment of the present invention will be described with reference to FIGS. 4 and 5.

The gamma unit 42 includes an inflection point setting unit 421 and a gamma conversion unit 422.

Referring to FIG. 5, the inflection point unit 421 sets a first inflection point TP1 (GX1, GY1) and a second inflection point TP2 (GX2, GY2). The gamma unit 42 performs gamma conversion so that gamma curves of the input image data R, G, B_Di pass through the first inflection point TP1 (GX1, GY1) and the second inflection point TP2 (GX2, GY2).

Hereinafter, a gamma conversion step performed by the gamma unit 42 will be described.

In the first step, the inflection point setting unit 421 sets the first inflection point TP1 (GX1, GY1) and the second inflection point TP2 (GX2, GY2). In this case, GX2 GX1, and GY2≥GY1.

In the second step, as illustrated with a dotted line in FIG. 5, the gamma conversion unit 422 generates a gamma curve directly proportional to the input image data R, G, B_Di, prior to gamma conversion. In this case, a maximum value of the input image data R, G, B_Di is the output image data R, G, B_Do.

In the third step, as illustrated with a solid line in FIG. 5, the gamma conversion unit 422 generates a converted gamma curve so that the gamma curve prior to the gamma conversion passes through the first inflection point TP1 (GX1, GY1) and the second inflection point TP2 (GX2, GY2). The gamma conversion unit 422 performs the gamma conversion by converting the gamma data using Equation 1 below.

$$\text{If, } (\text{Max_IN}<GX1)\text{Max_OUT}=\text{Max_IN}*GY1/GX1$$

$$\text{Else if, } (\text{Max_IN}=GX1)\text{Max_OUT}=GY1$$

$$\text{Else if, } (\text{Max_IN}<GX2)\text{Max_OUT}=(\text{Max_IN}-GX1)*(GY2-GY1)/(GX2-GX1)+GY1$$

$$\text{Else if, } (\text{Max_IN}=GX2)\text{Max_OUT}=GY2$$

$$\text{Else, Max_OUT}=(\text{Max_IN}-GX2)*(255-GY2)/(255-GX2)+GY2 \qquad \text{Equation 1}$$

In the fourth step, the gamma conversion unit 422 generates the converted gamma data to gamma image data R, G, B_Gamma including the gamma data of red R, green G, and blue B by using Equation 2 below.

$$\text{If, } (\text{Max_IN}>0)RO=RI*(\text{Max_OUT/Max_IN}),\ GO=GI*(\text{Max_OUT/Max_IN})BO=BI*(\text{Max_OUT/Max_IN})$$

$$\text{Else, } RO=RI=0GO=GI=0\ BO=BI=0 \qquad \text{Equation 2}$$

RI=input red gamma data, RO=converted red gamma data, GI=input green gamma data, GO=converted green gamma data, BI=input blue gamma data, and BO=converted blue gamma data.

The above description describes that the inflection point setting unit 421 sets two arbitrary inflection points for convenience of this description. However, the present invention is not limited thereto, and the inflection point setting unit 421 may set just one, or more than one, inflection point.

Figure 6:
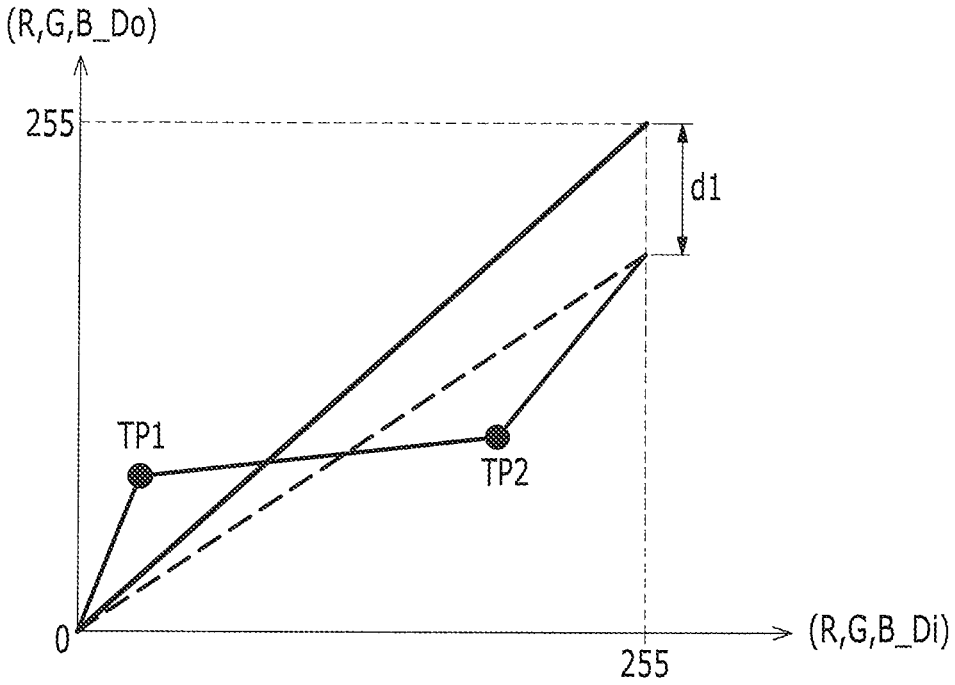
FIG. 6 is a graph illustrating a relationship between input image data and output image data according to an embodiment of the present invention.

FIG. 6 is a graph illustrating a relationship between the input image data and the output image data.

Hereinafter, a signal controller 40 according to the example embodiment of the present invention will be described with reference to FIG. 6.

In some embodiments, the signal controller 40 generates the output image data R, G, B_Do including the grayscale data by adding the decreased image data R, G, B_ACL and the gamma image data R, G, B_Gamma. The signal controller 40 generates data signal DR, DG, and DB of red R, green G, and blue B corresponding to the output image data R, G, B_Do.

The signal controller 40 may improve outdoor visibility by increasing a quantity of data at a low grayscale level (GX1 of the first inflection point), and decreasing power consumption by decreasing a quantity of data at a high grayscale level (GX2 of the second inflection point) and decreasing the data at the maximum grayscale level by d1.

Figure 7:
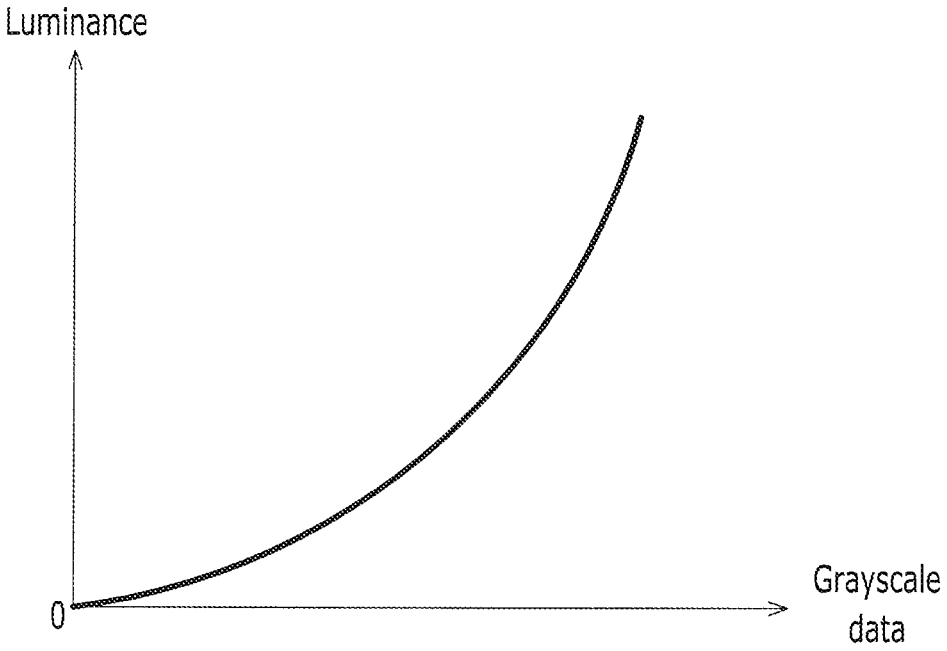
FIG. 7 is a graph illustrating a relationship between grayscale data and luminance according to an embodiment of the present invention.

FIG. 7 is a graph illustrating a relationship between the grayscale data and luminance.

Figure 8:
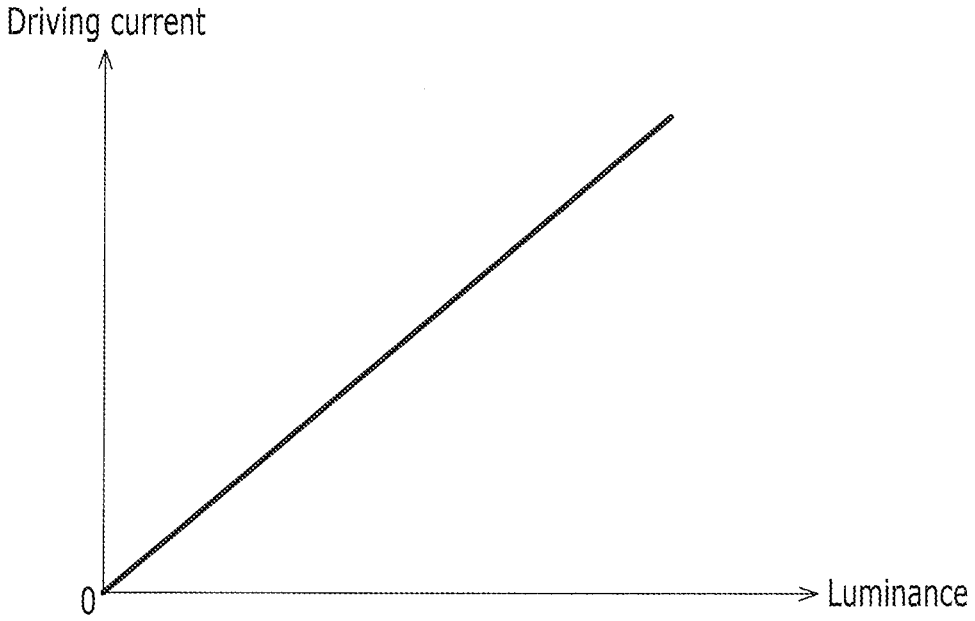
FIG. 8 is a graph illustrating a relationship between luminance and a driving current according to an embodiment of the present invention.

FIG. 8 is a graph illustrating a relationship between luminance and a driving current.

Figure 9:
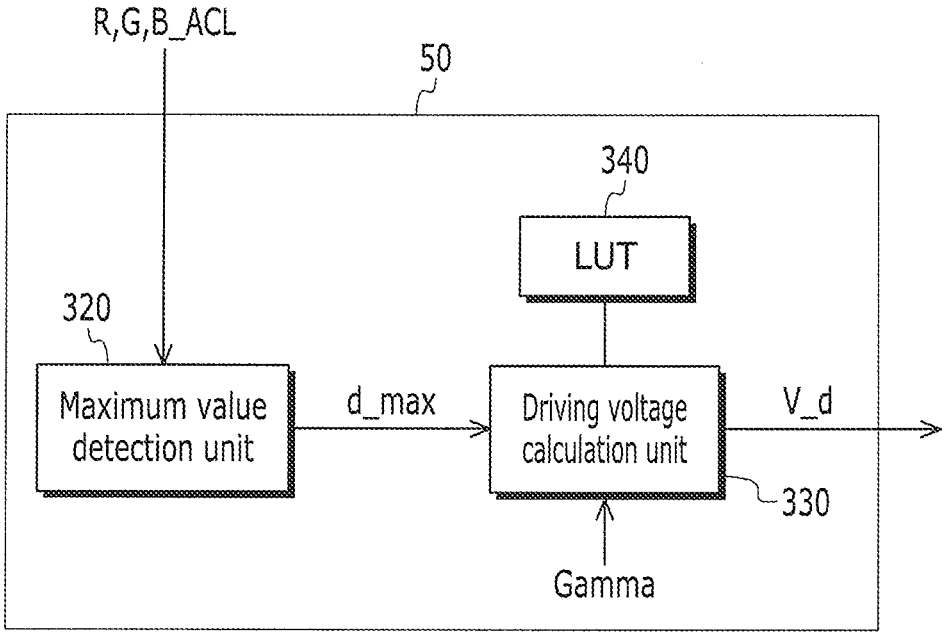
FIG. 9 illustrates a voltage difference setting unit according to an embodiment of the present invention.

FIG. 9 is a drawing illustrating a voltage difference setting unit.

Hereinafter, the voltage difference setting unit according to the example embodiment of the present invention will be described with reference to FIGS. 7 to 9.

Referring to FIG. 7, an x-axis of the gamma curve indicates values of the image data R, G, and B (e.g., values corresponding to grayscale data) to be displayed, and a y-axis indicates a luminance value of an image in which the corresponding image data is displayed. Here, the image data is represented by grayscale data, so the x-axis is represented with the grayscale data in FIG. 6. In some embodiments, the gamma curve has different data for each model of the panel 10, and may be set as a gamma curve having a specific form by a user.

Referring to FIG. 8, the x-axis indicates a luminance value and the y-axis indicates the driving current $I_{_oled}$ (e.g., see FIG. 2) for generating a specific luminance value. The luminance and the driving current $I_{_oled}$ have values proportional to each other. That is, to obtain high luminance, a value of the driving current is increased.

Referring to FIGS. 7 to 9, the voltage difference setting unit 50 may generate the luminance value by matching the grayscale data indicated by the decreased image data R, G, B_ACL to the gamma curve. The voltage difference setting unit 50 may generate the demanded driving current $I_{_oled}$ by using the generated luminance value.

The voltage difference setting unit 50 includes a maximum value detection unit 320, a driving voltage calculation unit (e.g., optimum voltage difference calculation unit) 330, and a lookup table 340.

The maximum value detection unit 320 detects a maximum value d_max among the decreased image data R, G, B_ACL.

For example, it is assumed that image data R, G, and B having a grayscale level value of 240 are included in the image data R, G, and B that forms one frame. The ACL unit 41 decreases the image data R, G, and B having the grayscale level of 240 by the first ratio (for example, 20%) described with reference to FIG. 3. When the decreased grayscale value of 192 (i.e., 240−(240*0.2)) becomes the maximum value d max among the decreased image data R, G, B_ACL, the maximum value detection unit 320 detects the grayscale level of 192 as the maximum value d_max.

The driving voltage calculation unit 330 calculates the voltage difference value V_d between the first voltage ELVDD and the second voltage ELVSS so that the driving current $I_{_oled}$ corresponding to the maximum value d_max is generated. For example, when the detected maximum value d_max is image data having the grayscale value of 192, the driving voltage calculation unit 330 calculates the driving current $I_{_oled}$ to generate a luminance corresponding to the data of the grayscale level of 192. That is, the difference value V_d between the first voltage ELVDD and the second voltage ELVSS determines the calculated driving current $I_{_oled}$. That is, the driving voltage calculation unit 330 optimizes the difference value V_d between the first voltage ELVDD and the second voltage ELVSS in accordance with the maximum value d_max of the decreased image data R, G, B_ACL.

The driving voltage calculation unit 330 calculates a luminance value corresponding to the maximum value d_max (which is also referred to as a "maximum luminance value") by using the gamma curve applied to the panel 10 and the maximum value d_max detected by the maximum value detection unit 320. Further, a value of the driving current $I_{_oled}$, through which the maximum luminance value is obtained, is calculated. Hereinafter, the value of the driving current $I_{_oled}$, through which the maximum luminance value is obtained, is referred to as the "demanded current". The driving voltage calculation unit 330 calculates the difference value V_d between the first voltage ELVDD and the second voltage ELVSS so that the demanded current is generated.

The lookup table 340 includes information about a driving voltage difference (ELVDD−ELVSS) corresponding to the demanded current.

The driving voltage calculation unit 330 detects a driving voltage difference corresponding to the demanded current in the lookup table 340, and determines the first voltage ELVDD and the second voltage ELVSS according to the driving voltage difference. The information about the determined first voltage ELVDD and second voltage ELVSS is transmitted to the power supply unit 60. Hereinafter, the difference value V_d between the first voltage ELVDD and second voltage ELVSS is referred to as the "driving voltage".

For example, when the voltage difference between the gate electrode and the source electrode of the driving transistor M1 is demanded by A to display the grayscale level of 192, the first voltage ELVDD is a voltage larger than the voltage Vdataj of the data signal displaying the grayscale level of 192 by A. However, the voltage difference between the gate electrode and the source electrode of the driving transistor demanded to display the grayscale level of 240 is B, and B is larger than A. Accordingly, the first voltage ELVDD is set as a voltage larger than that when the grayscale level is 192.

In related art, the first voltage ELVDD is set to be matched to the maximum grayscale level of 255 regardless of the maximum luminance. Therefore, power consumption is very high. Power is determined by multiplication of a voltage and a current, and in a case where the same driving current flows, when the driving voltage is high, the power consumption is increased. That is, if the driving current remains constant when the driving voltage is increases, power consumption will also increase.

According to the example embodiment of the present invention, a minimum driving voltage for supplying a driving current to calculate the maximum luminance in the image in one frame is supplied to the pixel circuit, thereby minimizing power consumption.

Here, the driving voltage calculation unit 330 omits a process of calculating the demanded current, and may directly detect the driving voltage corresponding to the maximum luminance value in the lookup table 340. In this case, the lookup table 340 stores information about the driving voltage corresponding to the maximum luminance value. That is, the driving voltage calculation unit 330 calculates the maximum luminance value corresponding to the maximum value d_max, and detects the driving voltage corresponding to the maximum luminance value by using the lookup table 340.

Figure 10:
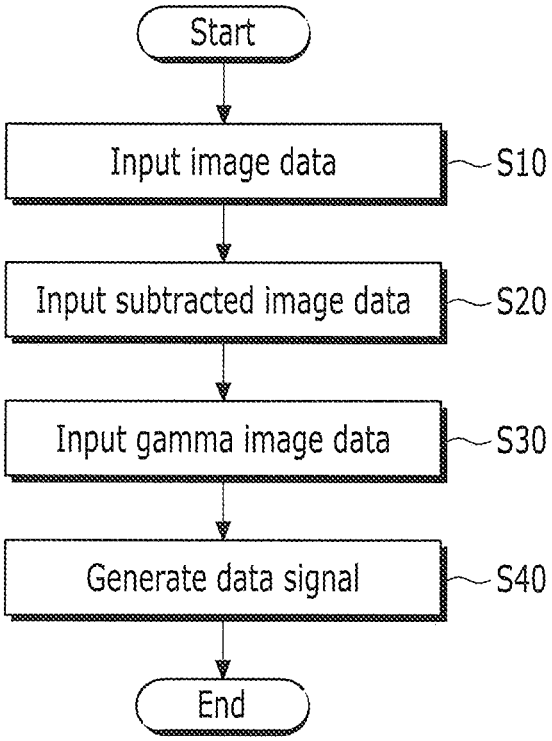
FIG. 10 is a flowchart illustrating a driving method according to an example embodiment of the present invention.

FIG. 10 is a flowchart illustrating a driving method (S10-S40) according to an example embodiment of the present invention. For example, an image data is inputted (S10). Then a substracted image data is inputted (S20). Next, a gamma image data is inputted (S30). Finally, a data signal is generated (S40).

Hereinafter, a driving method according to an example embodiment of the present invention will be described with reference to FIG. 10.

While embodiments of the present invention have been described in connection with what is presently considered to be practical example embodiments, it is to be understood that the invention is not limited to the disclosed embodiments, but, to the contrary, it is intended to cover various modifications and equivalent arrangements included within the spirit and scope of the appended claims.

DESCRIPTION OF SYMBOLS

1: Display device
10: Panel
20: Scan driver
30: Data driver
40: Signal controller
41: ACL unit
42: Gamma unit
50: Voltage difference setting unit
60: Power supply unit

What is claimed is:

1. A display device, comprising:

a panel including a plurality of pixel circuits, each of the pixel circuits comprising a light emitting device comprising a first terminal coupled to a first voltage, and a second terminal coupled to a second voltage;

a signal controller configured to:

generate output image data by gamma converting and by decreasing input image data of a frame according to a gamma curve; and generate a control signal to display an image on the panel according to the generated output image data;

a voltage difference setting unit configured to detect a maximum value of the decreased input image data, and configured to calculate a difference value between the first voltage and the second voltage so that a driving current corresponding to the maximum value is generated; and a power supply unit configured to generate and apply the first and second voltages to the panel, the generated first and second voltages corresponding to the calculated difference value, wherein the gamma curve comprises one or more inflection points and an output image data curve comprises one or more corresponding inflection points corresponding to the one or more inflection points of the gamma curve, and wherein a section of the output image data curve is between one of the one or more corresponding inflection points and the maximum value of the decreased input image data.

2. The display device of claim 1, wherein the one or more inflection points of the gamma curve comprises a first inflection point and a second inflection point.

3. The display device of claim 2, wherein the gamma curve represents a relationship between the input image data corresponding to grayscale data and the output image data.

4. The display device of claim 3, wherein the signal controller comprises a gamma conversion unit configured to perform gamma conversion, wherein the gamma conversion unit is configured to generate a converted gamma curve such that the gamma curve prior to the gamma conversion passes through the first and second inflection points.

5. The display device of claim 4, wherein:

the converted gamma curve comprises a first section, a second section, and a third section, wherein the first section comprises a first inclination formed between a starting point of the converted gamma curve and the first inflection point, wherein the second section comprises a second inclination formed between the first inflection point and the second inflection point, and wherein the third section comprises a third inclination formed between the second inflection point and a maximum value of the input image data.

6. The display device of claim 5, wherein:

the first inclination is larger than the second inclination; and the third inclination is larger than the second inclination.

7. The display device of claim 6, wherein a grayscale section corresponding to the first section is lower than a grayscale section corresponding to the second section.

8. The display device of claim 7, wherein the gamma conversion unit is configured to gamma convert the input image data corresponding to the first grayscale section among all grayscale levels according to the first inclination, and is also configured to:

perform the gamma conversion for the first section according to the first inclination;

perform the gamma conversion for the second section according to the second inclination; and perform the gamma conversion for the third section according to the third inclination.

9. The display device of claim 8, wherein:

the gamma conversion unit is configured to generate the gamma converted image data including red, green, and blue gamma data by using the gamma converted gamma data.

10. A method of driving a display device comprising a panel having a plurality of pixel circuits, each of which comprises a light emitting device comprising a first terminal coupled to a first voltage, and a second terminal coupled to a second voltage, the method comprising:

gamma converting input image data of a frame unit according to a gamma curve comprising one or more inflection points;

decreasing the input image data;

generating output image data by using the decreased image data and gamma converted image data; and generating a control signal to display an image according to the generated output image data, wherein an output image data curve comprises one or more corresponding inflection points corresponding to the one or more inflection points of the gamma curve, and wherein a section of the output image data curve is between one of the one or more corresponding inflection points and a maximum value of the decreased input image data.

11. The method of claim 10, wherein the decreasing the input image data comprises:

detecting the maximum value among the decreased input image data;

calculating a difference value between the first voltage and the second voltage;

generating a driving current corresponding to the maximum value; and generating the first voltage and the second voltage according to the calculated difference value.

12. The method of claim 11, wherein:

the one or more inflection points comprises a first inflection point and a second inflection point.

13. The method of claim 12, wherein:

the gamma curve represents a relationship between the input image data, which corresponds to grayscale data, and the output image data.

14. The method of claim 13, wherein the gamma converting further comprises generating a converted gamma curve such that the gamma curve prior to gamma conversion passes through the first inflection point and the second inflection point.

15. The method of claim 14, wherein:

the converted gamma curve comprises a first section, a second section, and a third section;

the first section comprises a first inclination between a starting point of the converted gamma curve and the first inflection point;

the second section comprises a second inclination between the first inflection point and the second inflection point; and the third section comprises a third inclination between the second inflection point and a maximum value of the input image data.

16. The method of claim 15, wherein:

the first inclination is larger than the second inclination; and the third inclination is larger than the second inclination.

17. The method of claim 16, wherein the gamma converting further comprises:

performing the gamma conversion for the first section according to the first inclination;

performing the gamma conversion for the second section according to the second inclination; and performing the gamma conversion for the third section according to the third inclination.

18. The method of claim 17, wherein a grayscale section corresponding to first section is lower than a grayscale section corresponding to the second section.

19. The method of claim 18, wherein the gamma converting further comprises generating the gamma converted image data including red, green, and blue gamma data by using the gamma converted gamma data.

* * * * *